United States Patent [19]

Takekoshi et al.

[11] Patent Number: 4,834,565

[45] Date of Patent: May 30, 1989

[54] DRIVING MECHANISM FOR A PRINTER HEAD

[75] Inventors: Makoto Takekoshi; Masahisa Inagaki; Haruhiko Tokunaga, all of Yokohama, Japan

[73] Assignee: Fujitsu Limited, Kawasaki, Japan

[21] Appl. No.: 919,755

[22] Filed: Oct. 16, 1988

[30] Foreign Application Priority Data

Oct. 19, 1985 [JP] Japan ..... 60-234088
Mar. 18, 1986 [JP] Japan ..... 61-59741

[51] Int. Cl.[4] ..... B41J 25/28

[52] U.S. Cl. ..... 400/320; 400/323; 400/328

[58] Field of Search ..... 400/320, 322, 328, 121, 400/124, 352, 354, 354.1, 354.2, 335, 323; 101/93.04, 93.05; 74/110

[56] References Cited

U.S. PATENT DOCUMENTS 4,203,680 5/1980 Mitrovich ..... 400/320 X
4,349,284 9/1982 Andersson ..... 400/328 X
4,359,289 11/1982 Barrus et al. ..... 400/322

*Primary Examiner*—Charles A. Pearson

*Attorney, Agent, or Firm*—Staas & Halsey

[57] ABSTRACT

A printer head is connected to its counterbalance by a counter drive in a manner to reduce shock and noise when the printer head is reciprocated by a linear motor. The counter drive comprises a pulley and a pair of belts or wires which are wound approximately half way around the pulley in respective opposite directions on opposite sides of the pulley, with one end of each belt being connected to the counterbalance, and the other end of each belt being connected to the printer head. Thus, the counterbalance moves in the opposite direction of the printer head. A movable element of the linear motor is connected coaxially to the counterbalance, in a manner such that the weight of the movable element is included in the total weight of the counterbalance. The printer head is mounted on a carriage which the carriage has a roller spaced laterally from the shaft. slides along a shaft. The roller rolls along a rail extending in parallelism to the shaft and a spring is connected between the axis of the roller and the rail to urge the roller toward the rail and prevent the roller from releasing from the rail. The energy necessary to reverse the motion of the printer head at each end of the mechanism is reduced by spring action.

13 Claims, 8 Drawing Sheets

FIG. 2 (A) PRIOR ART
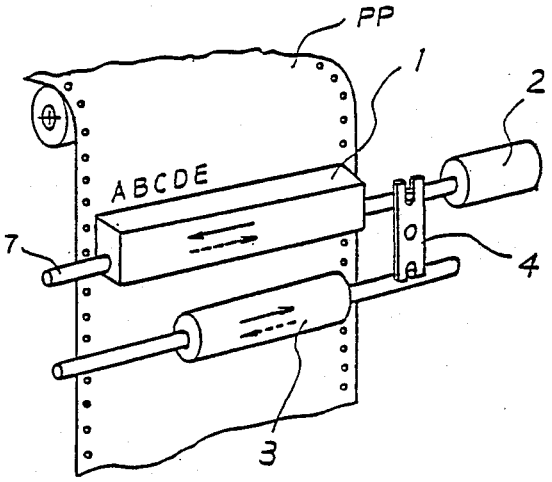
FIG. 2 (B) PRIOR ART
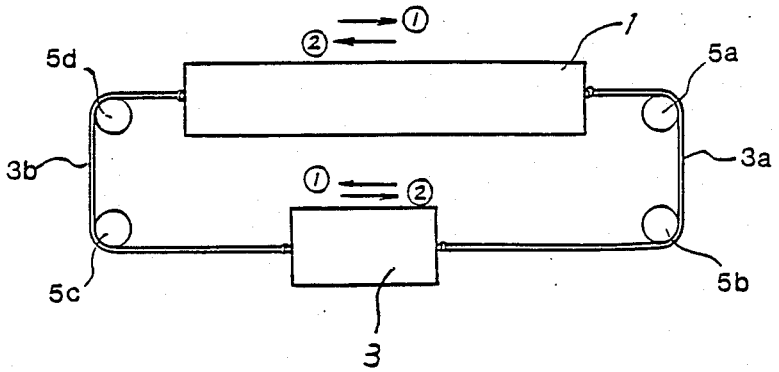

DRIVING MECHANISM FOR A PRINTER HEAD

BACKGROUND OF THE INVENTION

The present invention relates to a driving mechanism for a reciprocating, sheet scanning printer head, which mechanism is capable of absorbing shock, vibration and noise caused by movement of the head.

Recently high speed operation is becoming the most intensive requirement for printers. Therefore, printers having a plurality of printer heads are being used to increase the printing speed. The driving mechanism of such high speed printers must be such that noise and shock are precluded when the heads perform their reciprocal motion. And it is also desirable that the size of the printer be small, and that the repair of malfunctions of the mechanism be accomplished easily and quickly.

DESCRIPTION OF THE PRIOR ART

FIG. 1 is a schematic plan view of a prior art printer head driving mechanism. In FIG. 1, the printer head 1 is coupled with a linear motor 2 by the wires 3*a* and 3*b* wound around pulleys 5*a*–5*d*. The linear motor 2 drives the printer head 1 reciprocally left and right along the guide shaft 7. The mechanism includes frames 4*a* and 4*b* and the guide shaft 7 is fixed to the frames 4*a* and 4*b*. A guide roller 6 is provided for the printer head, and a shaft 8 is fixed to the yoke of the linear motor 2.

In such a printer, which is sometimes referred to as a shuttle printer, vibration and noise are generated because the printer head 1 reciprocates at high speed. It has been found that such vibration and noise may be prevented by the provision of a counterbalance 3 as illustrated in FIG. 2(A), which is driven by a pivotable link 4 in the opposite direction to the direction of motion of the printer head 1.

Another prior art structure is illustrated in FIG. 2(B). In this instance the printer head 1 and the counterbalance 3 are coupled with wires or tape 3*a* and 3*b* trained around pulleys 5*a*–5*d*. In this case, the driving motor 2 may be used as a counterbalance. Accordingly, it is known in the art to provide counter transmission mechanisms comprising pivotable links or wire or tape couplings.

However, the prior art structures employing pivotable links inevitably generate noise. For smooth operation of mechanisms such as those shown in FIG. 2(A), it is necessary to precisely align the guide shafts of the printer head and the counterbalance. For this purpose, self-aligning shafts are often used resulting in increased cost.

In structures such as those illustrated in FIG. 2(B), space is needed for training the wire. Moreover, as shown in FIG. 1, the pulleys 5*a*–5*d* are positioned on both sides of the apparatus, so the size of the printer becomes large. There is also a problem resulting from the elongation of the wire due to heat generated by high speed operation of the printer head. If the wire becomes slack the printed copy is degraded. Further, if the wire breaks, it is troublesome and time consuming to replace the wire in the narrow confines of the printer.

Printers are generally provided with a guide mechanism for guiding the reciprocal movement of the printer heads. A prior art guide mechanism is illustrated in FIG. 3. The printer head 1 is carried by a mounting structure 11. A guide shaft 7 extends through one side of structure 11 and guides the reciprocal motion thereof. A roller 6 is provided at the other side of structure 11.

Roller 6 rolls on a rail 31 and is held between the rail 31 and a rectangular C-shaped stopper 32 which prevents the release of roller 6 from the rail 31. The reference numeral 20 designates a platen.

A small gap is generally provided between the stopper 32 and the roller 6 to facilitate smooth rotation of the latter. But such gap allows the release of roller 6 from rail 31, and as a result, structure 11 is permitted to rotate around guide shaft 7, causing a slight misalignment of head 1 and platen 20. Therefore precise adjustment was necessary in order to achieve high print quality.

SUMMARY OF THE INVENTION

It is therefore an object of the present invention to provide a small size printer head driving mechanism which eliminates the disadvantages of the prior art mechanisms described above, and assure smooth operation of the printer head.

In order to achieve these objects, the present invention provides three principal inventive improvements. Firstly, the invention provides a counter transmission mechanism for coupling the printer head and counterbalance in a novel manner. Secondly, the invention facilitates the reduction of the total mass of the moving parts by utilizing the printer head driving linear actuator as a counterbalance. Thirdly the invention provides a spring for maintaining the guide roller against the guide rail and reducing the energy needed for the return motion of the printer head.

The principle of the counter transmission mechanism of the invention is explained with reference to FIG. 4 where it can be seen that the mechanism includes a counterbalance 3 which comprises a first elongated shaft 30 connected to counterbalance 3. Counterbalance 3 includes the movable portions of the actuator motor which drive shaft 30 to the left and right. A second shaft 40 which is parallel to shaft 30 is connected to and guides the motion of printer head 1. A pulley 5 is provided between shaft 30 and shaft 40, and a pair of elongated, flexible, pulley following belts 6*a* (unhatched) and 7*a* (hatched) are wound around pulley 5 in respective opposite directions to each other, each for a half turn along the circumference of pulley 5. A respective end of each of the belts 6*a* and 7*a* is fixed to shaft 30, while the other end of each belt 6*a* and 7*a* is fixed to shaft 40.

When print head 1 is moved to the right as shown by the solid arrow from A to B, pulley 5 rotates in a counterclockwise direction as shown by the solid circular arrow from A to B, so the counterbalance 3 moves to the left in the direction of the solid arrow from A to B, that is in the opposite direction to the movement of the printer head 1. Conversely, when printer head 1 moves to the left as shown by the broken line arrow from B to A, pulley 5 and counterbalance 3 move respectively in the directions shown by the broken line arrow. By such counter transmission mechanism, the reciprocating movement of shaft 30 is transmitted to shaft 30 as a counter reciprocating movement.

The pulley 5 and the belts 6*a* and 7*a* do not need to be on opposite sides of the device as shown in FIG. 1, and accordingly, the apparatus can be reduced in size. And repairs for malfunctions can be made easily by opening only one side of the apparatus.

The above mentioned second improvement is realized by utilizing the movable part of the linear motor as the counterbalance 3 as illustrated in FIG. 4. This improvement together with the third improvement will be described with reference to the following preferred embodiments.

Other objects and advantages of the invention will become apparent from the following description of the preferred embodiments, the appended claims and the accompanying drawings.

BRIEF DESCRIPTION OF THE DRAWINGS

FIG. 2 illustrates the principle of prior art methods for driving the printer head and counterbalance in opposite directions to each other, wherein:

FIG. 2(A) illustrates counter driving by a lever; and

FIG. 2(B) illustrates counter driving by a wire or belt.

FIG. 11 schematically illustrates a modification wherein the guide mechanism is applied for use in a case of a longer scan length.

Throughout the drawings, the same or similar reference numerals designated the same or corresponding parts.

DESCRIPTION OF THE PREFERRED EMBODIMENTS

Figure 5:
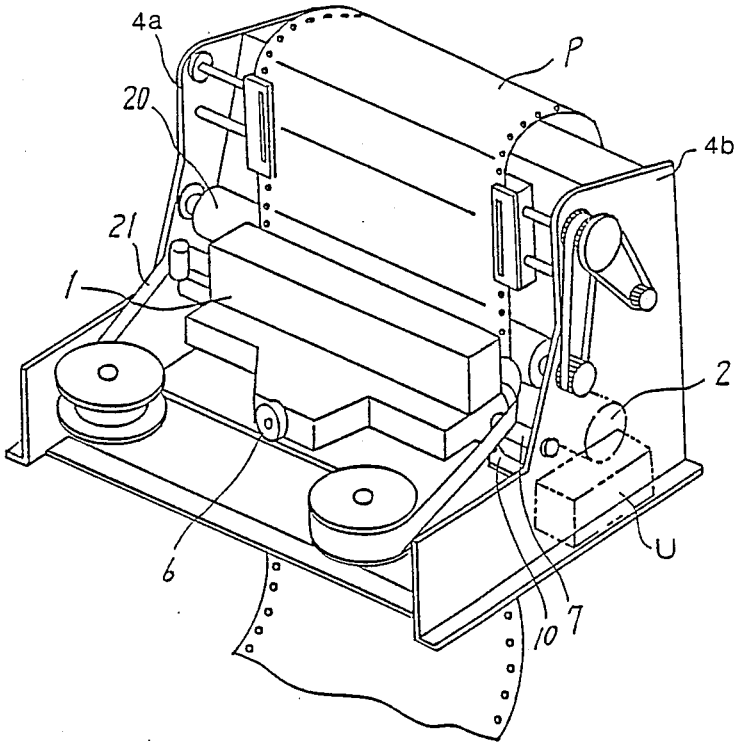
FIG. 5 schematically illustrates the outer appearance of a printing apparatus which embodies the present invention.

FIG. 5 schematically illustrates an example of a printer apparatus which embodies the present invention. In FIG. 5, the printer head 1 is guided by guide means in the form of a guide shaft 7 and a guide roller 6, and is reciprocated to the right and left by a linear motor 2 via the counter driving transmission unit U. The linear motor 2 is disposed beneath the platen 20 which supports a sheet P. A coupling plate 10 is provided for coupling the printer head 1 and the counter driving transmission unit U. Although not shown in FIG. 5, counterbalance 3 is disposed at the lower part of the platen 20.

In FIG. 5, the driving motor 2 and counterbalance 3 (not shown) are arranged on opposite sides of the printing paper P from the printer head 1, but the arrangement of these compmonents may be modified, and they can be arranged on the same side (in front for example) of the paper.

Since the counter driving unit U is provided at a single side of the apparatus, it will be understood that the width of the printer apparatus may be reduced in size compared to apparatuses of the prior art, and repair of the counter driving unit can be done from one side of the apparatus.

Figure 6:
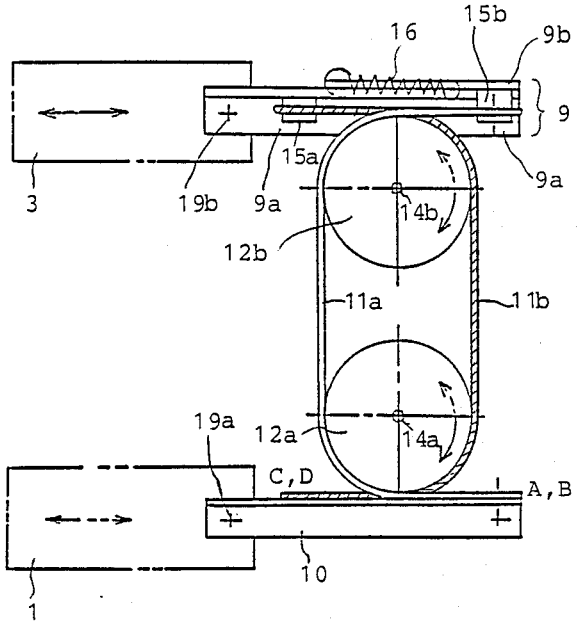
FIG. 6 is a plan view schematically illustrating the principles of an embodiment of the counter driving transmission unit of the present invention.
Figure 7:
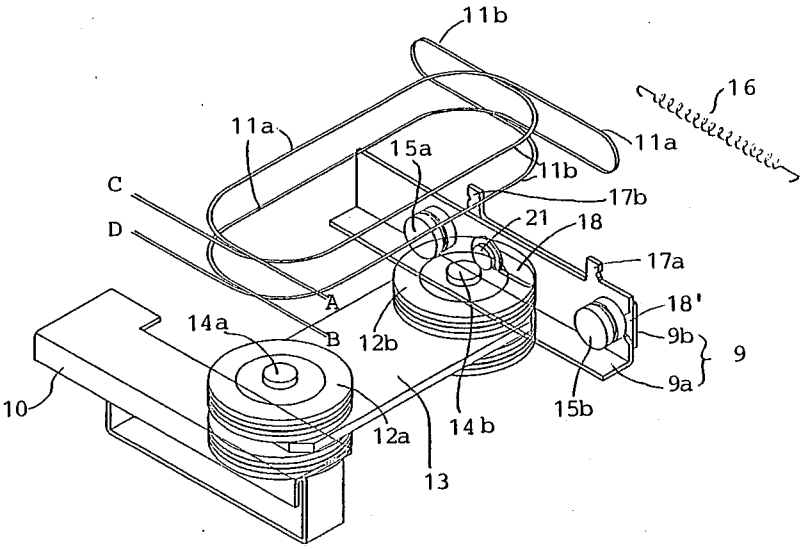
FIG. 7 is an exploded perspective view illustrating the structure of the counter driving transmission illustrated in FIG. 6.

FIG. 6 is a schematic plan view of the counter driving unit U of the present invention illustratig its principles of operation, and FIG. 7 is an exploded perspective view of the counter driving unit U.

Figure 4:
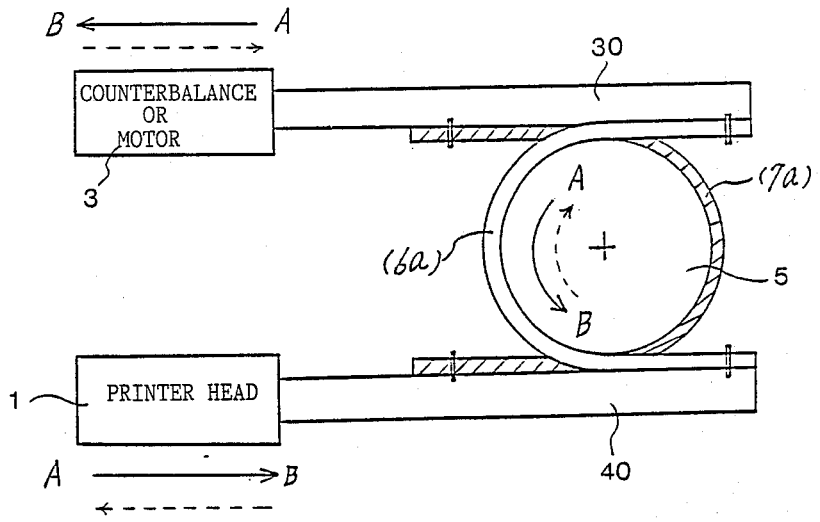
FIG. 4 illustrates the principles of the counter driving transmission mechanism of the present invention.

In the embodiment of FIGS. 6 and 7, the pulley 5 of FIG. 4 is replaced with a pair of pulleys 12*a* and 12*b* which are used for increasing the distance between printer head 1 and counterbalance 3 for convenience of assembling components of the printer apparatus. The belts 6*a* and 7*a* of the FIG. 4 embodiment are respectively replaced by steel wires 11*a* (unhatched) and 11b (hatched). These steel wires are trained around the pulleys 12*a* and 12*b* which are rotatable around shafts 14*a* and 14*b* fixed to a mounting plate 13 (FIG. 7).

In the embodiment of FIGS. 6 and 7, an elongated connecting structure in the form of a first coupling plate 9 is screwed to the counterbalance 3 by a screw 19*b*, while another elongated connecting structure in the form of coupling plate 10 (second coupling plate) is screwed to the printer head 1 by a screw 19*a*. Respective ends of the wires 11*a* and 11*b* are fixed respectively to the first and second coupling plates 9 and 10, and are wound or trained half way around the pulleys 12*a* and 12*b* in opposite directions to each other in the form of the letter x. Wires 11*a* and 11*b* are respectively wound around each pulley approximately a quarter of a turn on opposite sides of the pulleys.

As can be seen in FIGS. 6 and 7, the first coupling plate 9 is composed of two portions 9*a* and 9*b*. The first portion 9*a* is provided with a first pin 15*a* and a first projection 17*a*, while the second portion 9*b* is provided with a second pin 15*b* and a second projection 17*b*. The first and second portions 9*a* and 9*b* are coupled so as to be relatively longitudinally shiftable in parallel to each other. Such shifting is guided by movement of a holding screw 21 along a guide hole 18 and a slit 18′ which allows the root of the second pin 15*b* to pass. Therefore, it will be understood that if a tension spring 16 is provided between the first and second projections 17*a* and 17*b*, the first and second pins 15*a* and 15*b* will be resiliently urged apart to thus apply a tension to the wires 11*a* and 11*b* trained around the pins 15*a* and 15*b*.

In FIGS. 6 and 7, the one end A of the wire 11*a* is fixed (although not illustrated) to the coupling plate 10 with fastening means. The wire 11*a* passes around one side of the pulleys 12*a* and 12*b* making ¼ turn around each of them, turns around the second pin 15*b*, turns back again making another ¼ turn around the same side of the pulleys 12*a* and 12*b*, and is fixed at its other end B to plate 10 by the same fastening means as end A. Similarly, end C of the wire 11*b* is fixed to the second coupling plate 10 with another fastening means (not shown), wire 11*b* passes another one side of the pulleys 12*a* and 12*b* making ¼ turn around the opposite sides from wire 11*a*, turns around the first pin 15*a*, turns back again making ¼ turn around each pulley, and its other end D is fixed by the same fastening means as end C. The pulleys 12*a*, 12*b* and pins 15*a*, 15*b* are respectively provided with grooves to prevent the dislocation of the wires. As mentioned above, slackening of the wires is prevented by the tension spring 16 connected between the projection 17*a* and 17*b*. The mechanism to prevent slackening of the wires as described above is but an example, various modifications being possible. The fastening means for fixing the ends of the wires 11*a*, 11*b* may also be of any kind. A bolt and nut or many other known fasteners may be possible. A simple one is to hook knots in the wire in properly shaped holes.

In FIG. 6, when the linear motor drives the counterbalance 3 in the direction of the solid arrow line, the pair of wires 11*a*, 11*b* rotate the pair of pulleys 12*a*, 12*b* as indicated by the solid arrow mark, causing the printer head 1 to move in the direction indicated by the solid arrow mark. If the linear motor drives the counterbalance 3 in opposite direction as shown by the dotted arrow mark, all the components move in the opposite direction indicated by the dotted arrow marks. In this case, the tension spring 16 absorbs the shock of the reverse movements of the components and prevents the positional misalignment of the printer head.

If the linear motor is positioned coaxially with the counterbalance, the moving parts of the linear motor may be included in the weight of the counterbalance, so, the total weight of the moving part is saved. This is effective for reducing the driving power of the linear motor.

Since the counter transmission mechanism of FIG. 6 uses two folded wires 11*a* and 11*b*, the wire strength is twice as much as that of a single wire, and this facilitates longer operational life.

Moreover, since the counter transmission mechanism is formed as a unit, the replacement of wires 11*a*, 11*b* can be accomplished by replacing the entire unit. Thus, the unit may be repaired within the short period of time because this is realized by simply fixing or removing the coupling plates 9 and 10 to/from the printer head 1 and the linear motor 2 with the screws 19*a* and 19*b*. This aspect will become more apparent with respect to FIG. 8.

Figure 8:
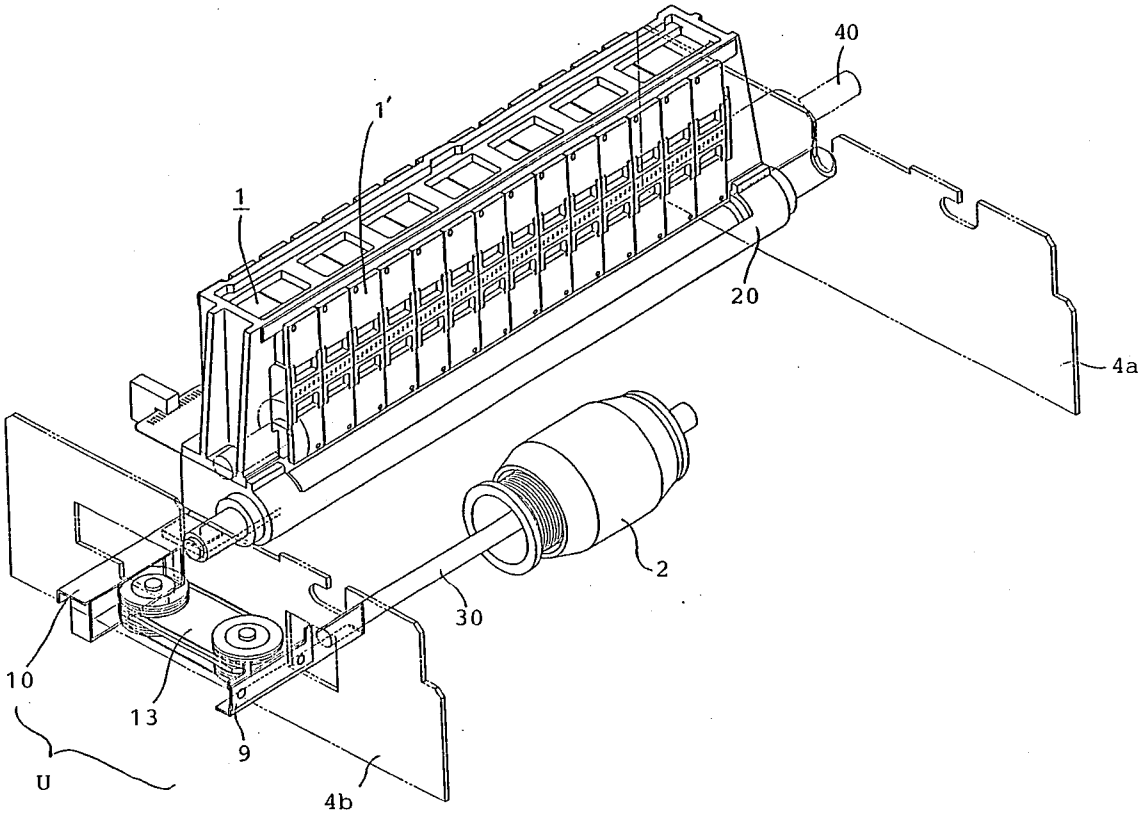
FIG. 8 illustrates the interrelationship of respective portions of a printer apparatus which utilizes the counter driving transmission unit of the present invention.

In the FIG. 8 embodiment, a steel wire is used as the belt, but it can be replaced with any material which is flexible and does not stretch. Therefore, a steel belt for example may be applicable.

FIG. 8 is a perspective view illustrating the part of the printer apparatus to which the driving mechanism of the present invention is applied. This figure also illustrates the coupling relationship of the various parts of the apparatus viewed from the rear side of FIG. 5. The frame 4*b* is provided with apertures through which the coupling plates 9, 10 extend. The plates 9, 10 are screwed respectively to the printer head 1 and the linear motor 2. The mounting plate 13 of the reverse coupling transmission unit U is also screwed to the frame 4*b*. As described above, it will be understood that such constructon is very convenient for replacement of the reverse coupling unit U.

Although not illustrated, the core of the linear motor 2 is mounted on the frame by a known means. In the embodiment illustrated in FIG. 8, the yoke moves in the direction of the shaft 30 which is supported slidably along its axis by appropriate known means, such as bearings for example. The movement of the yoke is transmitted to the reverse coupling unit U by the shaft 30 and the coupling plate 9.

As illustrated in FIG. 8, the yoke of the linear motor and the shaft 30 provide the counterbalance for the printer head 1. Since the printer head is generally heavy, the shaft 30 may be formed thick and in some cases may be provided with a weight (not shown).

The embodiment illustrated in FIG. 8 employs a multihead type printer head 1, which is provided with fourteen dot printer heads 1' arranged in parallel to increase the printing speed. The print head driving mechanism of the present invention is especially useful for such high speed printers, whose heavy printer head reciprocates left and right quickly. But the type of the printer head may be any kind, for example, a single printer head, a thermal printer head or an ink jet printer head may be used.

A variety of types of linear motors are available in the market, and there is not restriction on the type of linear motor except that it have the necessary driving force and stroke length. Therefore, further description of the linear motor is omitted. Moreover, linear actuators such as pulse motors provided with gears may also be used in place of the linear motor.

Figure 9:
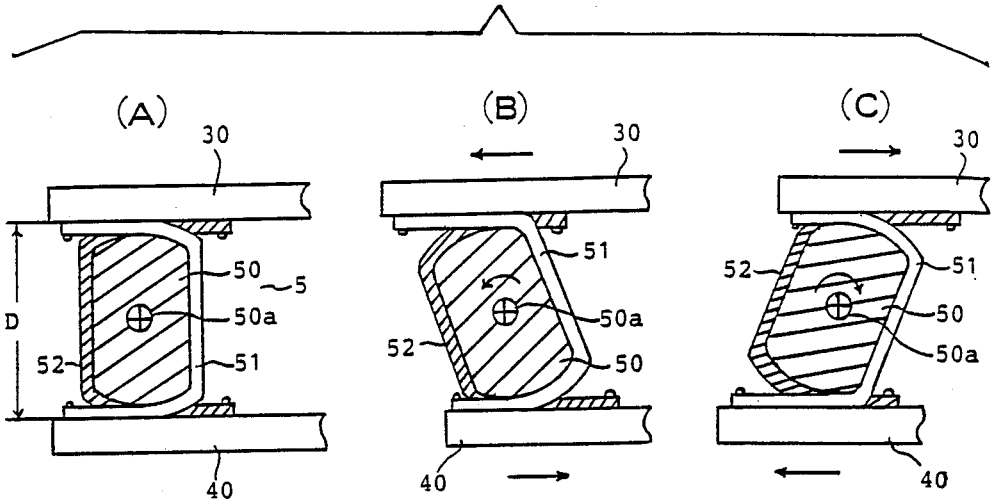
FIG. 9 illustrates an embodiment of the invention where a cam is used in place of the pulley of FIG. 4.

In the above embodiments, the counter transmission mechanism employs a circular pulley, but the pulley does not always need to be a circular one, especially for multihead type printers where the strok from left to right is not so large. An example of a modification of the pulley shape is illustrated in FIG. 9. In this example, the pulley is replaced by a cam 50 having the form of a circle which is truncated at both of its sides.

The embodiment illustrated in FIG. 9 provides the effect that unnecessary parts are cut away and unwanted weight and inertia can thus be eliminated. Such cam is effective when the distance between the first and second shafts is large.

In FIG. 9, the cam 50 has a circular equivalent peripheral diameter D including the thickness of the belts 51 and 52, which is equal to the distance between the shafts 30 and 40. The center of the cam 50 is supported by and rotatable around an axle 50*a*. The belts 51, 52 are formed from metal ribbons or wires, which are wound around the cam and fixed to the shafts 30 and 40 in similar manner to the various embodiments described above. If the diameter of the cam is large, it will be apparent from FIGS. 9 (A), (B) and (C) that a sufficient stroke of the printer head can be achieved with only a small rotation of the cam.

Figure 10:
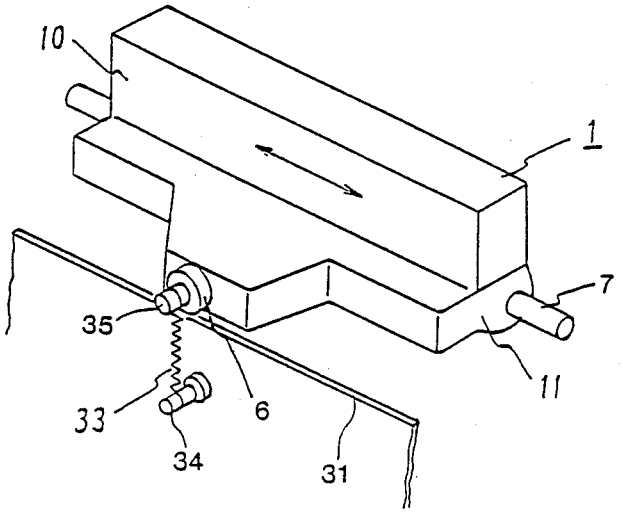
FIG. 10 schematically illustrates a guide mechanism for guiding the movement of a printer head in accordance with the present invention.

Next, a guide mechanism for the printer head will be described. As has been described with respect to FIG. 3, some looseness of the guide roller 6 is inevitable in prior art mechanisms. This looseness causes misalignment of the print head and decreases the print quality. FIG. 10 illustrates schematically a guiding mechanism for the printer head provided by the present invention. The printer head 1 is mounted on a mounting structure 11. Structure 11 is supported at one side by a first shaft 7, and structure 11 is slidable along shaft 7. On the other side of structure 11 a guide roller 6 is provided for rolling along a rail 31. The shaft 35 of the roller 6 is engaged to one end of spring 33, and the other end of the spring 33 is engaged to a pin 34 fixed on a side of the rail 31. So, the guide roller 6 is resiliently urged toward the rail 7.

Figure 1:
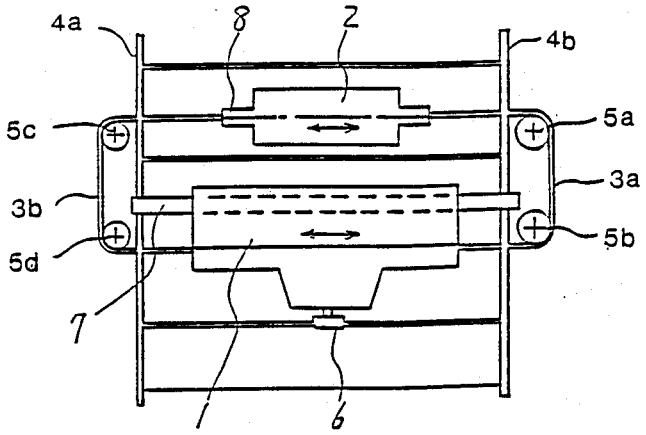
FIG. 1 PRIOR ART
FIG. 1 schematically illustrates the principle of operation of printer head driving mechanisms of the prior art.
Figure 3:
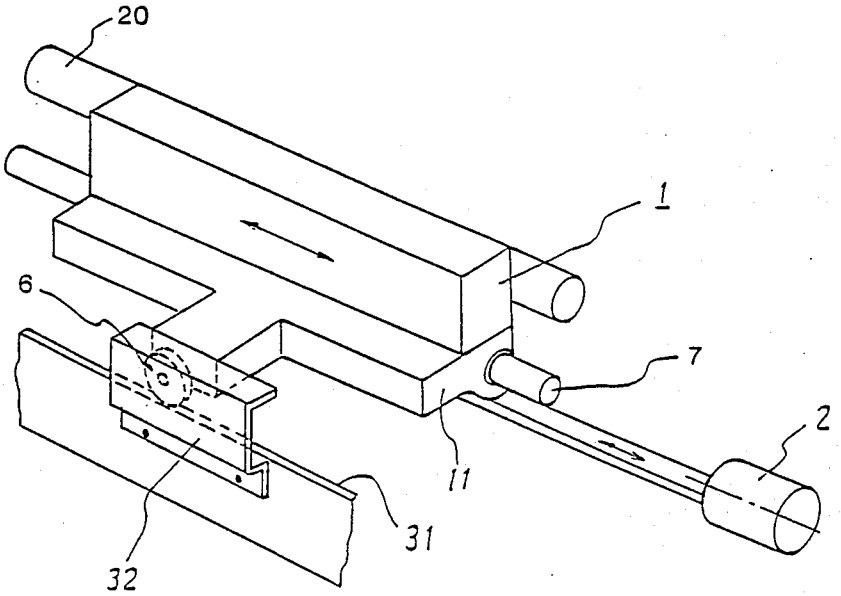
FIG. 3 PRIOR ART
FIG. 3 illustrates schematically a prior art guide mechanism for guiding the movement of the printer head.

Compared to the prior art structure of FIG. 3, the present invention utilizes the tension of the spring 33 to prevent the disengagement of the roller 6 from its guide rail 31. The roller 6 is resiliently urged toward rail 31, and it moves smoothly along the rail 31 without disengagement from it. So, the deterioration of printing quality due to the looseness of the guide roller 6 which has been seen in the prior art is eliminated. Such guide mechanism requires almost no adjustment to keep the roller tightly on the rail 31. So, the defects of the prior art mechanism are eliminated perfectly and easily.

Moreover, since one end of the spring 33 is fixed to the rail 31 by the pin 34, the spring 33 is pulled and epanded when the structure 11 moves left and right along the shaft 7, providing a strong recovery force. Therefore, at the movement of reverse movement at the turn around points of the printer head, where the maximum energy is required for driving the head, the driving force is enhanced by the force of the spring.

Particularly when high speed printing is carried out using a multihead type printer, the time required for reciprocal movement of the printer head is short, and the load on the linear motor for reciprocating the printer head becomes large. So, by using such spring, the driving energy of the linear motor is saved, and a smaller motor can be used. Or a higher operation speed compared to prior art mechanism can be attained if the same size linear motor is used.

The structure illustrated in FIG. 10 does not present any problem when the scan length of the printer head is short, but results in some decrease in the scanning speed when the scan length is long. This is because the component of tensile force of the spring 33 in the direction of movement of the printer head is reversed at the center point of the scanning.

In order to avoid such problem, the embodiment of FIG. 11 is provided with a slide groove 35 that is parallel to the rail 31, and the spring attachment pin 34 is fixed on a slider 36 which is slidable along the slide groove 35. Such sliding mechanism is a conventional one. It may be a pulley or any kind of slider. It should be pointed out that any looseness between the slider 36 and the sliding groove 35 is also absorbed by the spring 33.

The length of the slide groove 35 should be a little shorter than the scanning length. So, in most parts of the scanning, the slider 36 moves together with the structure 11 and the tension force of the spring 33 is used principally to pull the roller 30 toward the rail 31, and no longitudinal forces are imposed on mounting structure 11. But when the printer head approaches its reverse points E or E', that is the end points of the scanning, the slider 36 is stopped by the end point of the sliding groove 35, and the spring 33 is elongated to apply a force to pull back the mounting structure 11. By such mechanism, the problem of variations in scanning speed is avoided.

In the foregoing embodiments, a coil spring 33 is used to pull the roller 6 toward the rail 31. But any type of spring may be used, and leaf springs, for example, may be applicable. Many other modifications are also possible within the spirit of the invention, for example, the guiding rail 31 may be provided above the roller 6, and the roller 6 may be pulled up by a spring toward the rail.

The invention has been described with respect to some preferred embodiments, but such embodiments are not restrictive, and the present invention permits a variety of modifications within the scope of the subject matter and does not reject these modifications.

What is claimed is as follows:

1. A driving mechanism for a reciprocating sheet scanning printer head, said mechanism having opposite sides and including first elongated guide means having an end adjacent one of the sides of the mechanism for guiding reciprocating movement of the printer head along a first elongated parth, actuator means for reciprocating said head along said path, reciprocating counterbalance means having substantially the same weight as said head, second elongated guide means having an end adjacent said one side of the mechanism for guiding reciprocating movement of the counterbalance means along a second elongated path which is parallel to and laterally spaced from said first path, and counter transmission mechanism coupled between said head and said counterbalance means for transmitting motion between the head and the counterbalance means to cause relative movement of the counterbalance means and the head in opposite directions along their respective paths, said counter transmission mechanism comprising:

rotatable pulley means positioned between said first and second paths at only said ends thereof adjacent said one side of the mechanism;

a pair of elongated, flexible, pulley following elements wound around the pulley means in respective opposite directions, one end of each element being connected to the counterbalance means and the other end of each element being connected to the printer head; and a respective, elongated connecting structure for each of said head and said counterbalance means, said structures extending longitudinally of said paths toward said one side of the mechanism, the respective ends of said elements being connected to said structures in longitudinally spaced relationship.

2. Mechanism as set forth in claim 1, and means for tensioning said elements.

3. Mechanism as set forth in claim 1 wherein one of said structures comprises means for tensioning said elements.

4. Mechanism as set forth in claim 3 wherein said one structure includes a pair of relatively longitudinally shiftable portions, the corresponding end of one element being connected to one of said portions and the corresponding end of the other element being connected to the other one of said portions, said tensioning means comprising means for resiliently urging said portions apart to thereby tension the elements.

5. Mechanism as set forth in claim 1 wherein said pulley means comprises a pair of pulleys spaced laterally of said paths.

6. Mechanism a set forth in claim 1 wherein said pulley means comprises a pulley having a diameter substantially equal to the lateral distance between said paths.

7. Mechanism as set forth in claim 6 wherein said pulley is circular.

8. Mechanism as set forth in claim 6 wherein said pulley has the shape of a circle that has been truncated at each of its opposite sides.

9. Mechanism as set forth in claim 1 wherein said actuator means comprises a linear motor positioned so that its movable part moves longitudinally of and in alignment with said second path, said movable part being connected to said counterbalance means.

10. Mechanism as set forth in claim 1 wherein said first guide means includes an elongated shaft, means mounting said head on the shaft for longitudinal movement therealong, a rail disposed in spaced, parallel relationship to the shaft, a roller carried by the mounting means and disposed for rolling along said rail, and means resiliently urging said roller toward said rail.

11. Mechanism as set forth in claim 10 wherein said resilient means comprises a coil spring connected between the mounting means and said rail.

12. Mechanism as set forth in claim 11 wherein i s included structure for connecting the spring to said rail, said structure including means defining a slot extending longitudinally of the rail and a pin slidably mounting in the slot for movement longitudinally of the rail, said spring being connected to the pin.

13. A driving mechanism for a reciprocating sheet scanning printer head, said mechanism having opposite sides and including first elongated guide means having an end adjacent one of the sides of the mechanism for guiding reciprocating movement of the printer head along a first elongated path, actuator means for reciprocating said head along said path, reciprocating counterbalance means having substantially the same weight as said head, second elongated guide means having an end adjacent one side of the mechanism for guiding reciprocating movement of the counterbalance means along a second elongated path which is parallel to and laterally spaced from said first path, and counter transmission mechanism coupled between said head and said counterbalance means for transmitting motion between the head and the counterbalance means to cause relative movement of the counterbalance means and the head in opposite directions along their respective paths, said counter transmission mechanism comprising:

rotatable pulley means positioned between said first and second paths at only said ends thereof adjacent said one side of the mechanism; and a pair of elongated, flexible, pulley following elements wound around the pulley means in respective opposite directions, one end of each element being connected to the counterbalance means and the other end of each element being connected to the printer head, said first guide means including an elongated shaft, means mounting said head on the shaft for longitudinal movement therealong, a rail disposed in spaced, parallel relationship to the shaft, a roller carried by the mounting means and disposed for rolling along said rail, and coil spring means connected between the mounting means and said rail for resiliently urging said roller toward said rail, said mechanism including structure for connecting the spring to said rail, said structure including means defining a slot extending longitudinally of the rail and a pin slidably mounted in the slot for movement longitudinally of the rail, said spring being connected to the pin.

* * * * *

UNITED STATES PATENT AND TRADEMARK OFFICE

CERTIFICATE OF CORRECTION

PATENT NO. : 4,834,565

DATED : May 30, 1989

INVENTOR(S) : MAKOTO TAKEKOSHI,

It is certified that error appears in the above-identified patent and that said Letters Patent is hereby corrected as shown below:

Title page:

[57] ABSTRACT

Line 14, delete "the car-";

Line 15, delete "riage has a roller spaced laterally from the shaft.";

Line 16, after "shaft." insert --The carriage has a roller spaced laterally from the shaft.--.

Column 3, line 68, "compmonents" should be "components--.

Column 4, line 10, illustratig" should be --illustrating--.

Column 5, line 56, "structon" should be --struction--.

UNITED STATES PATENT AND TRADEMARK OFFICE

CERTIFICATE OF CORRECTION

PATENT NO. : 4,834,565

DATED : May 30, 1989

INVENTOR(S) : MAKOTO TAKEKOSHI, et al.

It is certified that error appears in the above-identified patent and that said Letters Patent is hereby corrected as shown below:

Column 6, line 23, "strok" should be -- stroke --.

Signed and Sealed this

Sixteenth Day of January, 1990

*Attest:*

JEFFREY M. SAMUELS

*Attesting Officer*

*Acting Commissioner of Patents and Trademarks*